US008469748B2

(12) United States Patent
Chambers

(10) Patent No.: US 8,469,748 B2
(45) Date of Patent: Jun. 25, 2013

(54) COUPLER WITH UNIVERSAL ADAPTORS FOR ELECTRICITY, COMPRESSED AIR, FLUIDS, AND DATA

(76) Inventor: Benjamin Gerald Chambers, Ruskin, FL (US)

( * ) Notice: Subject to any disclaimer, the term of this patent is extended or adjusted under 35 U.S.C. 154(b) by 0 days.

(21) Appl. No.: 12/820,116

(22) Filed: Jun. 21, 2010

(65) Prior Publication Data

US 2010/0323559 A1 Dec. 23, 2010

Related U.S. Application Data

(60) Provisional application No. 61/218,663, filed on Jun. 19, 2009.

(51) Int. Cl.
*H01R 33/00* (2006.01)

(52) U.S. Cl.
USPC ..... 439/638; 439/577

(58) Field of Classification Search
USPC 439/638, 535, 651, 574, 577; 174/481; 49/55
See application file for complete search history.

(56) References Cited

U.S. PATENT DOCUMENTS

| | | | | | |
|---|---|---|---|---|---|
| 3,744,004 | A * | 7/1973 | Kinsey | 439/654 |
| 4,085,434 | A * | 4/1978 | Stevens | 439/744 |
| 5,035,630 | A * | 7/1991 | Norsworthy | 439/638 |
| 5,135,413 | A * | 8/1992 | Pannizzo | 439/577 |
| 5,150,963 | A * | 9/1992 | Hill | 362/123 |
| 5,562,488 | A * | 10/1996 | Neiser et al. | 439/652 |
| 5,633,782 | A * | 5/1997 | Goodman et al. | 361/679.41 |
| 5,899,761 | A * | 5/1999 | Crane et al. | 439/654 |
| 5,931,702 | A * | 8/1999 | Fladung | 439/652 |
| 5,964,618 | A * | 10/1999 | McCarthy | 439/535 |
| 6,004,157 | A * | 12/1999 | Glass | 439/535 |
| 6,540,554 | B2 * | 4/2003 | McCarthy | 439/574 |
| D487,726 | S * | 3/2004 | Okuda | D13/156 |
| 6,971,911 | B2 * | 12/2005 | Ramsey et al. | 439/535 |
| 7,074,091 | B2 * | 7/2006 | Strayer | 439/652 |
| 7,083,421 | B1 * | 8/2006 | Mori | 439/574 |
| 7,140,922 | B2 * | 11/2006 | Luu et al. | 439/651 |
| 7,223,122 | B2 * | 5/2007 | Mori | 439/501 |
| 7,378,756 | B2 * | 5/2008 | Singer et al. | 439/651 |
| 7,442,090 | B2 * | 10/2008 | Mori et al. | 439/652 |
| 7,488,203 | B2 * | 2/2009 | Leddusire | 439/535 |
| 7,626,119 | B2 * | 12/2009 | Axland et al. | 439/652 |
| 7,736,178 | B2 * | 6/2010 | Byrne | 439/574 |
| 7,909,642 | B1 * | 3/2011 | Czarnecki et al. | 439/535 |
| 7,938,679 | B2 * | 5/2011 | Wadsworth et al. | 439/574 |
| 2008/0277133 | A1 * | 11/2008 | Axland et al. | 174/54 |

* cited by examiner

*Primary Examiner* — Briggitte R Hammond
(74) *Attorney, Agent, or Firm* — Kristina M. Grasso, Esq. PLLC

(57) ABSTRACT

This invention provides a coupler having universal adaptors for compressed air, fluid, electricity, and/or data that enable a user to connect existing hoses or cords to the coupler, which is attached to a door base and/or window sash, thus allowing the door and/or window to be fully opened and closed. The body of the coupler is a U shaped clamp. The body has a thin base plate that is positioned under the door and/or window and two walls that contain electrical/pneumatic/data connectors. In one embodiment, the body is made of a durable plastic. The clamp is tightened via a tension screw with an adjustment knob or by a screwdriver. Embedded within the body are channels that allow passage of electricity, air, fluid, and/or data packets.

21 Claims, 12 Drawing Sheets

COUPLER WITH UNIVERSAL ADAPTORS FOR ELECTRICITY, COMPRESSED AIR, FLUIDS, AND DATA

RELATED APPLICATIONS

This application claims the benefit of U.S. Provisional Application No. 61/218,663, filed Jun. 19, 2009, which is herein incorporated in its entirety by reference.

FIELD OF THE INVENTION

This invention relates to power adapters and outlets. More specifically, this invention relates to a coupler having universal adaptors that allow for the transfer of electricity, compressed air, fluid, and/or data under or beside a closed door, movable wall or window sash.

BACKGROUND OF THE INVENTION

Currently users of pneumatic tools, equipment having electrical power cords, fluid power systems, and/or data cables have to leave a door or window open to allow passage of hoses, cords, and/or cables into a workspace. This creates problems due to the escape or intrusion of hot or cold air, dust, noise, insects as well as damage to doors, windows, and walls. Having to leave the doors or windows open to allow the cords or hoses to pass through wastes enormous amounts of energy. There are also the inconvenience and safety issues created by not isolating the workspace, including the hazard of tripping and/or danger of pinching or cutting the cords, cables and/or hoses. Additionally, having the air/power/fluid source in the immediate work space creates noise, dust, and damage to floors and walls.

SUMMARY

This invention overcomes the disadvantages of the prior art by providing a coupler having universal adapters for compressed air, fluid, electricity, and/or data that enable a user to connect existing hoses or cords to the coupler, which is attached to a door base and/or window sash, thus allowing the door and/or window to be fully opened and closed. This invention has applications to a number of industries, including but not limited to, construction, information technology, medical, and aerospace.

The body of the coupler is a generally U shaped clamp. The body accommodates a door/wall/window thickness of 2⅔ inches up to 2¼ inches. The body has a thin base plate that is positioned under the door and/or window. In one embodiment, the body is made of a durable thermoplastic, e.g. ABS. In other embodiments, the body may be made of polyurethane or thermoplastic rubber. In one embodiment, the clamp is tightened via a tension screw with an adjustment knob. In an alternative embodiment, the tension screw is tightened by a screwdriver. In all embodiments, channels that allow passage of electricity, air, gas, fluid, and/or data are embedded within the body.

In one embodiment, a first wall of the clamp has one or more female electrical connectors, e.g. outlets. The second wall of the clamp has a male electrical connector, e.g. plug. In this embodiment, the channels within the body are lined with electrical conduit strips. In alternative embodiments, the female electrical connector may be positioned on a front surface, top surface, or side surface of the first wall. In the embodiment having the female electrical connector positioned on the top surface of the first wall, a protective cover for the outlet may be provided.

In a second embodiment, the first wall of the clamp has an open pneumatic fitting with an external (male) screw thread, while the second wall of the clamp has an open pneumatic fitting with an internal (female) screw thread.

In a third embodiment, the first wall of the clamp has one female electrical connector and an open pneumatic fitting with an external screw thread, while the second wall of the clamp has a male electrical connector and an open pneumatic fitting with an internal screw thread.

In a fourth embodiment, the first and second walls of the clamp have connections for composite or RCA cables, coaxial cables, ethernet cables, phone cords, and USB ports.

In a fifth embodiment, the first wall of the clamp has one female electrical connector, an open pneumatic fitting with an external screw thread, and connections for composite or RCA cables, coaxial cables, ethernet cables, phone cords, and USB ports. The second wall of the clamp has a male electrical connector, an open pneumatic fitting with an internal screw thread, and connections for composite or RCA cables, coaxial cables, ethernet cables, phone cords, and USB ports.

In an alternative embodiment, the body of the coupler is generally a C shaped clamp. The first wall of the clamp has at least two female electrical connectors positioned on the front surface. The second wall of the clamp has a spring loaded clip, thumb screw, or cam locking device that holds it to a piece of wood, bench, and/or ladder for remote power access.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

BRIEF DESCRIPTION OF THE DRAWINGS

The invention description below refers to the accompanying drawings, of which.

DETAILED DESCRIPTION

Figure 1:
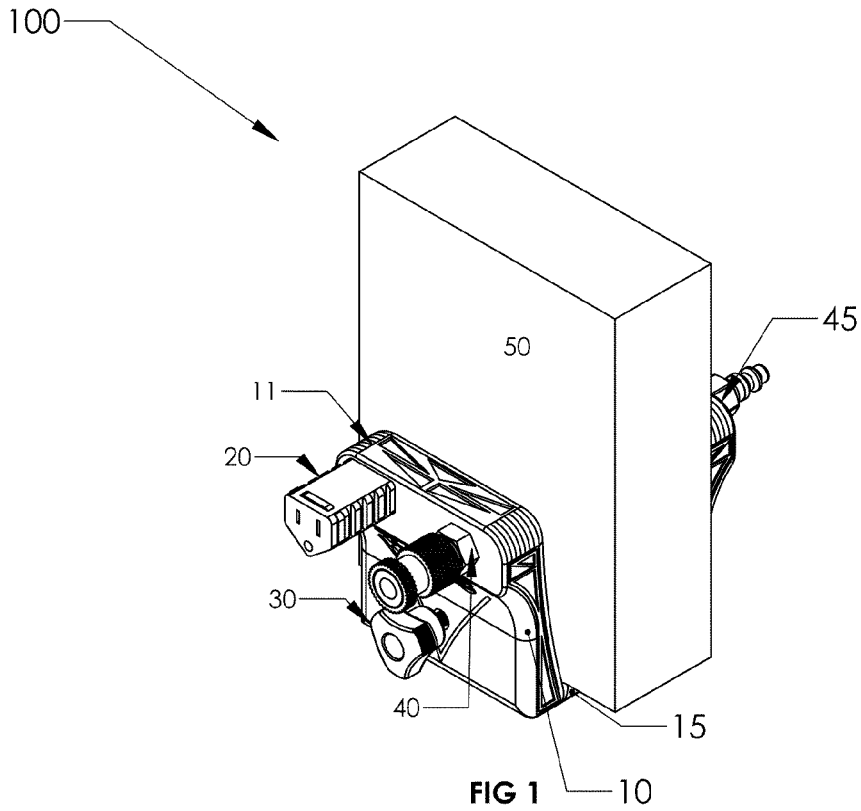
FIG. 1 is a perspective view of an embodiment of the present invention showing a female electrical connector and an open pneumatic fitting.

Referring to the drawings in general and to FIGS. 1-18 in particular, there is provided a coupler having universal adapters that allow for the transfer of electricity, compressed air, fluid, and/or data under or beside a closed door, movable wall or window sash in accordance with the present invention.

Figure 2:
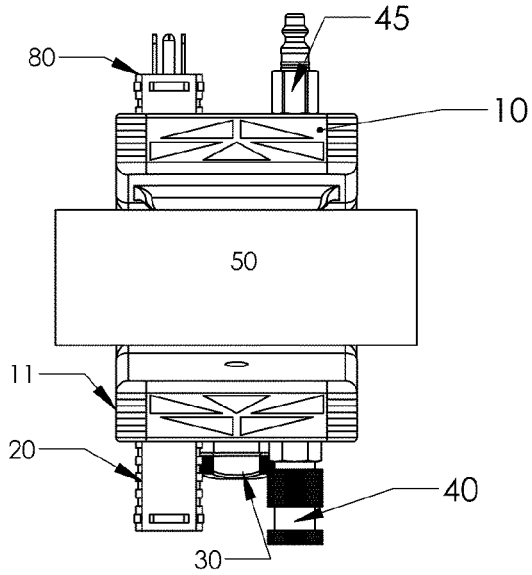
FIG. 2 is a top view thereof.
Figure 3:
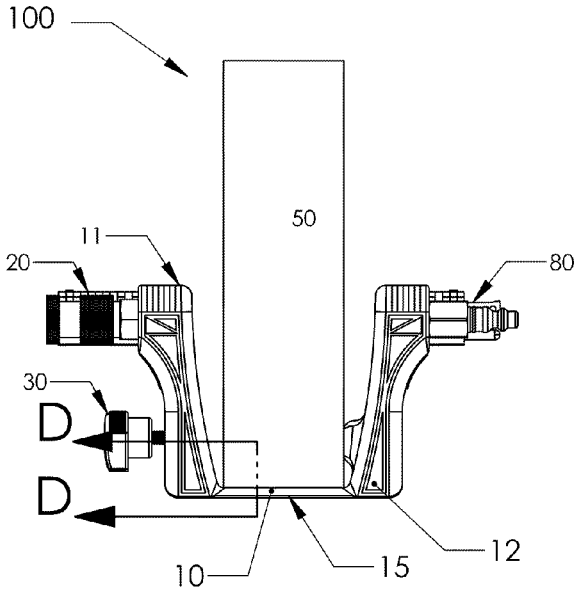
FIG. 3 is a side view thereof.

Referring to FIGS. 1-3, the coupler 100 includes a body 10. Body 10 of coupler 100 is a generally U shaped clamp. In one embodiment, body 10 is made of a durable thermoplastic, such as ABS. In other embodiments, the body may be made of polyurethane or thermoplastic rubber. Body 10 is capable of accommodating a door/wall/window thickness of 2⅔ inches up to 2¼ inches between first wall 11 and second wall 12. Body 10 has a base plate 15 that is positioned under door 50. Base plate 15 integrally connects first wall 11 and second wall 12. In one embodiment, base plate 15 has a thickness of 0.2 inches. In one embodiment, body 10 is tightened around door 50 via a tension screw with an adjustment knob 30. In an alternative embodiment, the tension screw is tightened by a screwdriver.

In one embodiment, one female electrical connector 20, e.g. outlet, is positioned on a side surface of first wall 11 of body 10. First wall 11 of body 10 also has an open pneumatic fitting with an internal (female) screw thread 40. A male electrical connector 80, e.g. plug, is positioned on a side surface of second wall 12 of body 10. An open pneumatic fitting with an external (male) screw thread 45 is positioned next to male electrical connector 80.

Figure 4:
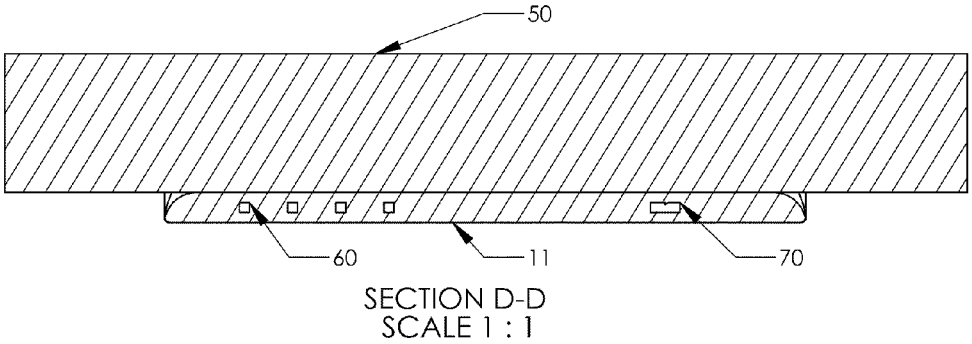
FIG. 4 is a cross section view across line D-D of FIG. 3.

Referring to FIG. 4, which is a cross sectional view taken along line D-D of FIG. 3, embedded within body 10 are channels 60, 70. Channels 60 allow passage of electricity between female electrical connector 20 and male electrical connector 80. Channels 70 allow passage of air, gas, and/or fluid between open pneumatic fitting with an internal (female) screw thread 40 and open pneumatic fitting with an external (male) screw thread 45 with no impedance to volume flow rate.

Figure 5:
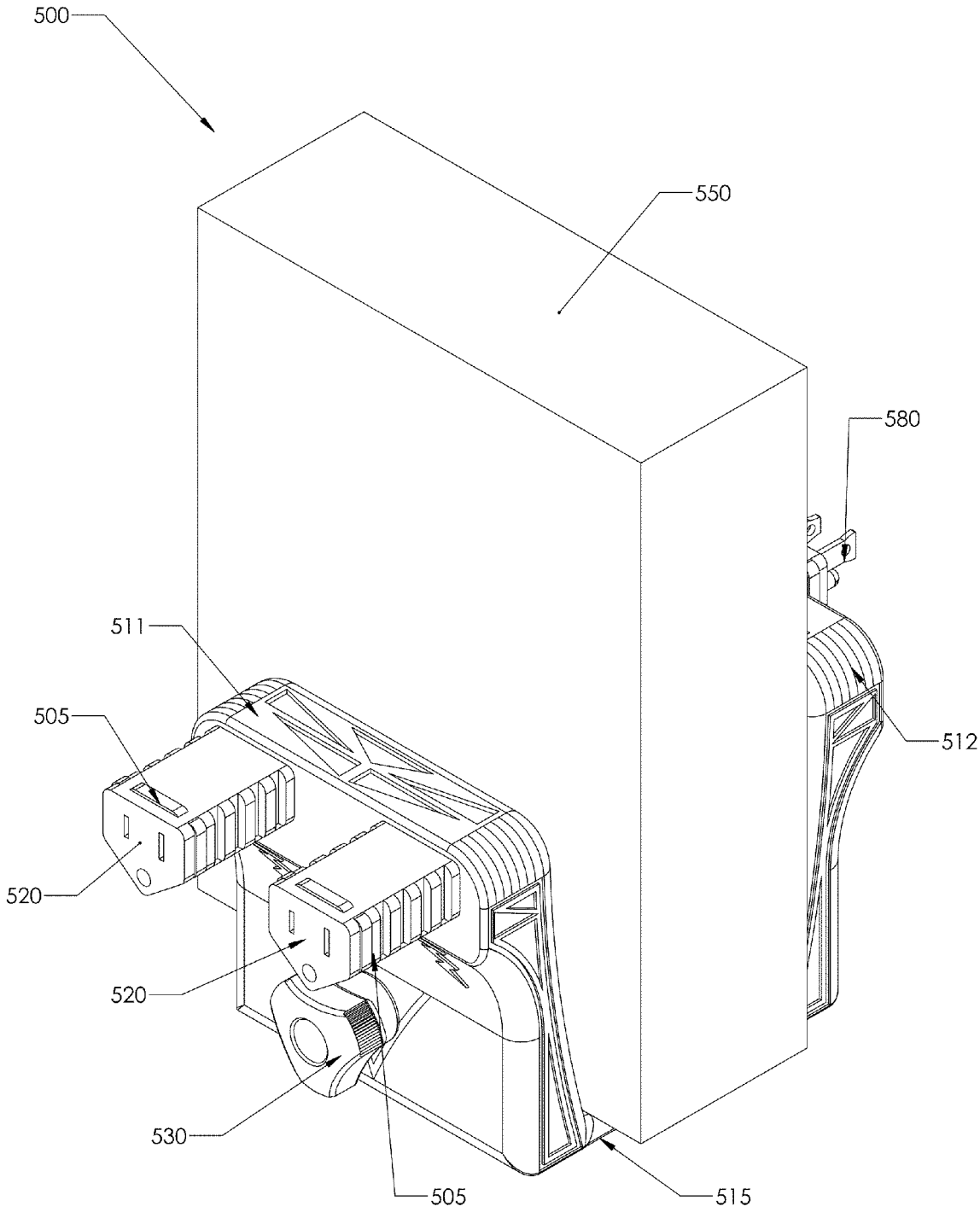
FIG. 5 is an alternative embodiment of the present invention showing extended female electrical connectors.

In an alternative embodiment, shown in FIG. 5, coupler 500 has two female electrical connectors 520 positioned on a side surface of first wall 511 of body 510. In this embodiment, female electrical connectors 520 extend from first wall 511. Female electrical connectors 520 have indicator lights 505 to signal if the female electrical connector 520 is too hot to plug into. A tension screw with an adjustment knob 530 is positioned below female electrical connectors 520. A male electrical connector 580 is positioned on a side surface of second wall 512 of body 510. Base plate 515 integrally connects first wall 511 and second wall 512.

Figure 6:
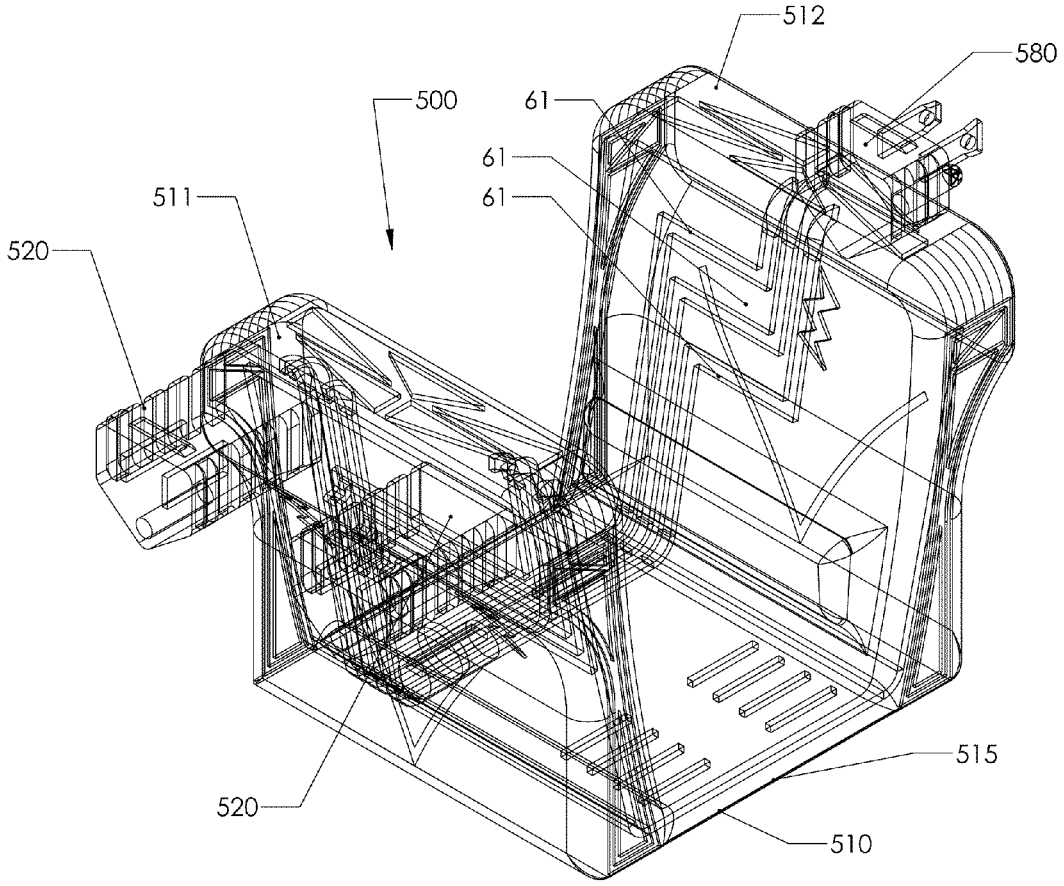
FIG. 6 is an interior view of FIG. 5 showing the transmission channels.
Figure 7:
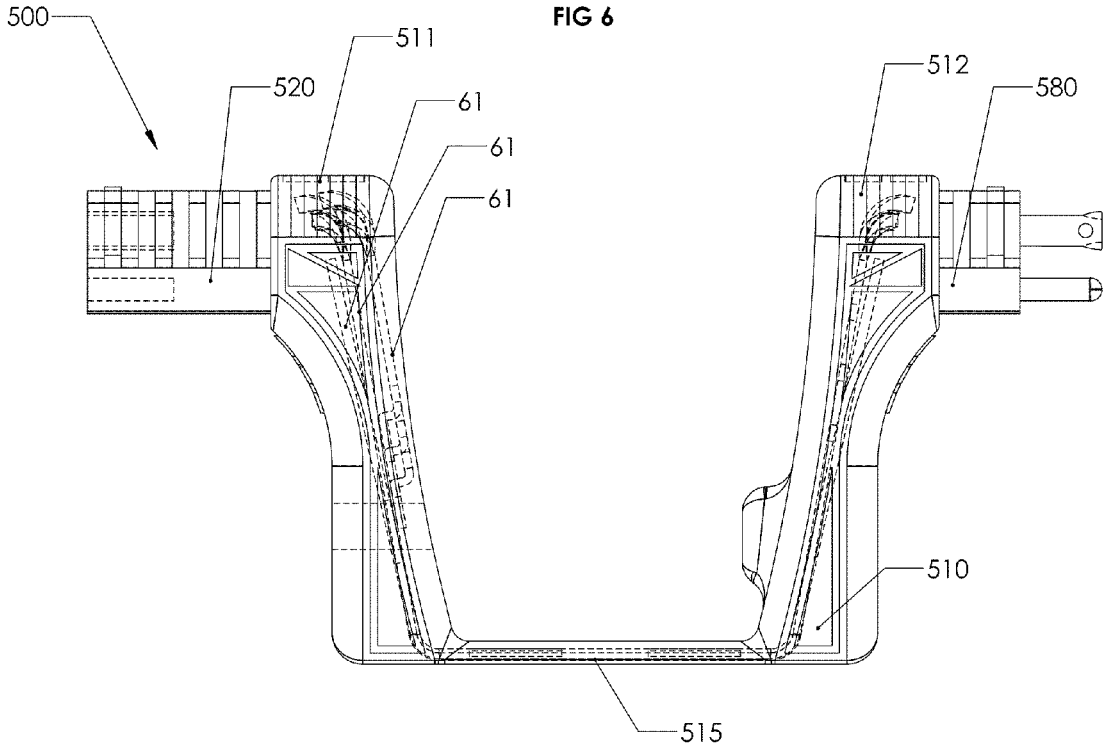
FIG. 7 is a side view of FIG. 6.

Referring to FIGS. 6 and 7, channels 60 within body 10 are lined with electrical conduit strips 61. Electrical conduit strips 61 run from female electrical connector 20 through first wall 11, base plate 15 and second wall 12 to male electrical connector 80. In one embodiment, electrical conduit strips 61 are made of copper.

Figure 9:
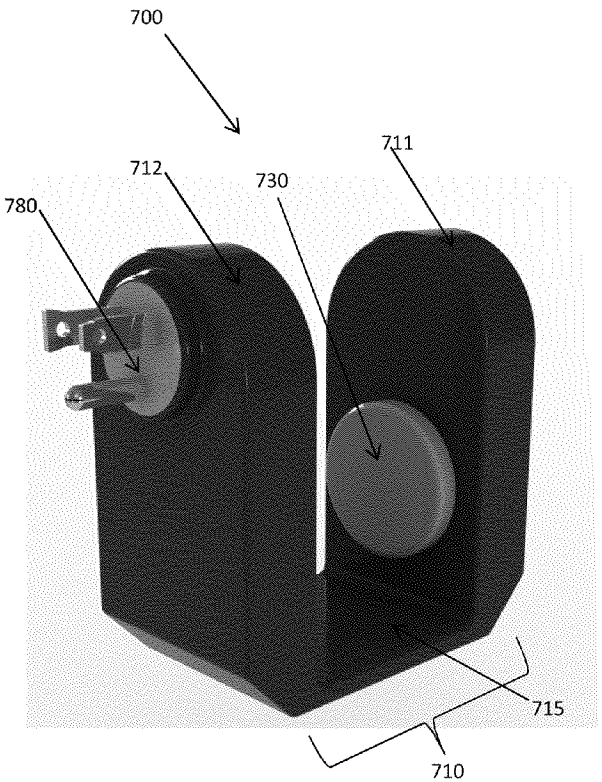
FIG. 9 is a second perspective view of the embodiment of FIG. 8 showing a male electrical connector.
Figure 8:
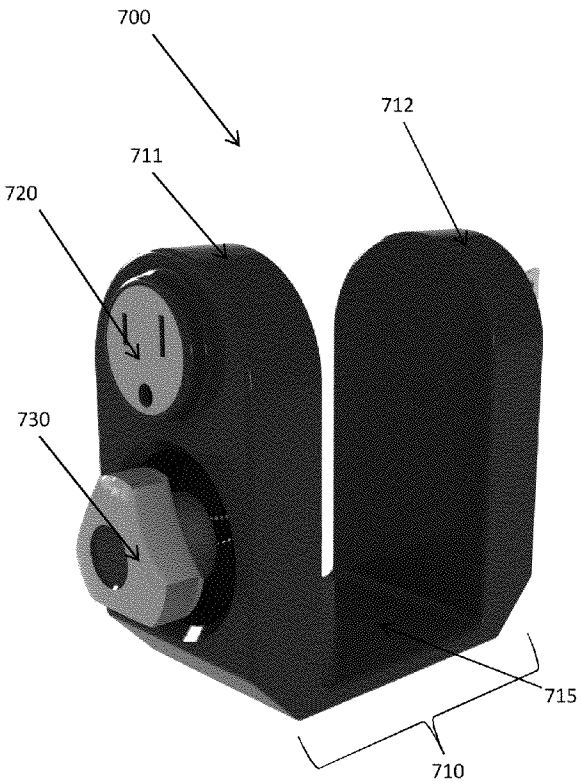
FIG. 8 is a perspective view of an alternative embodiment of the present invention showing a single female electrical connector.

In an alternative embodiment, shown in FIG. 8, coupler 700 has a single female electrical connector 720 on a side surface of first wall 711 of body 710. A tension screw with an adjustment knob 730 is positioned below female electrical connector 720. As seen in FIG. 9, a male electrical connector 780 is positioned on a side surface of second wall 712 of body 710. Base plate 715 integrally connects first wall 711 and second wall 712.

Figure 10:
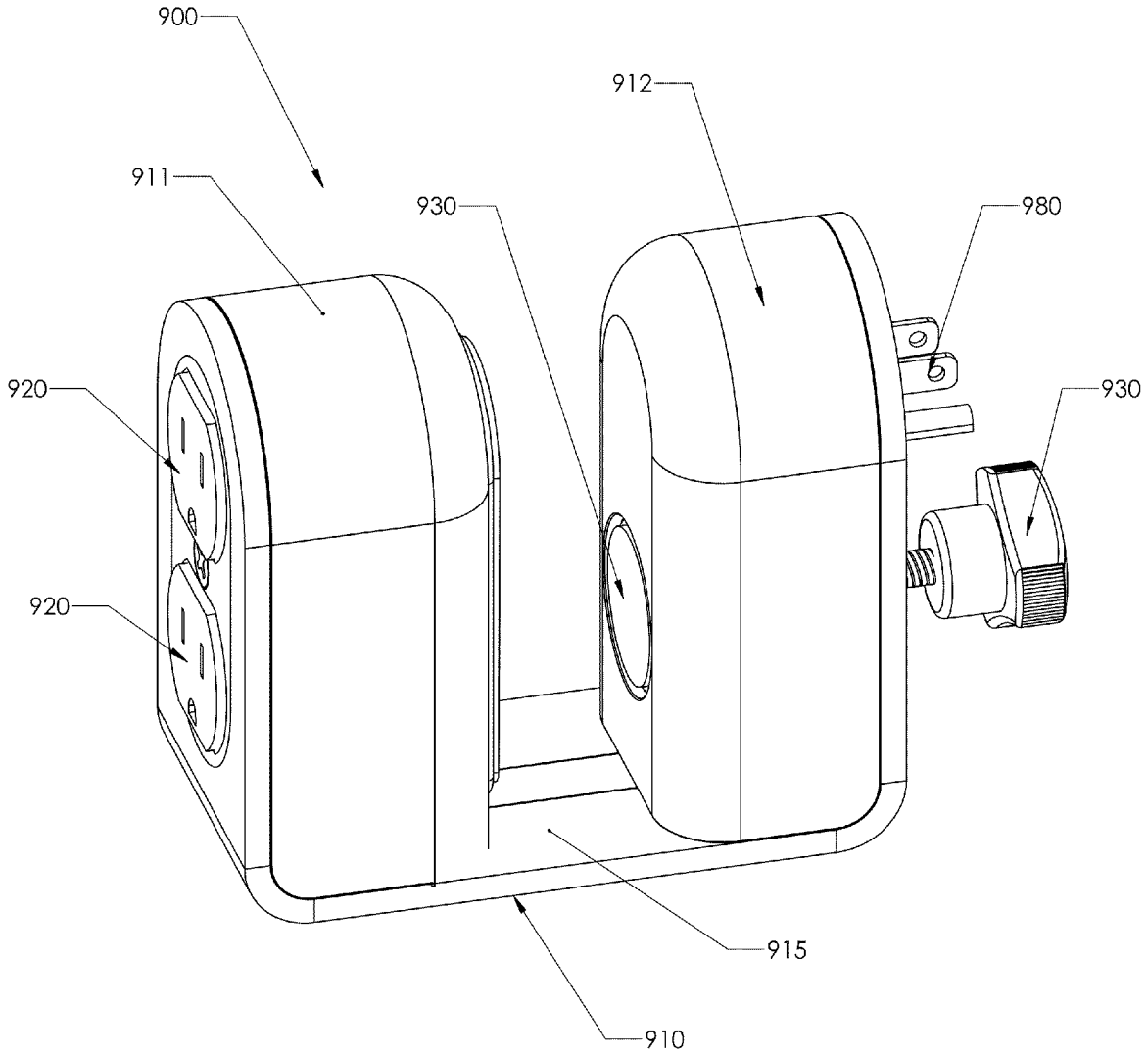
FIG. 10 is a perspective view of another embodiment of the present invention showing two female electrical connectors positioned vertically on one wall.

In an alternative embodiment, shown in FIG. 10, coupler 900 has two female electrical connectors 920 on first wall 911 of body 910. The female electrical connectors 920 are positioned vertically on a side surface of first wall 911 of body 910. A male electrical connector 980 is positioned on a side surface of second wall 912 of body 910. A tension screw with an adjustment knob 930 is positioned below male electrical connector 980. Base plate 915 integrally connects first wall 911 and second wall 912.

Figure 12:
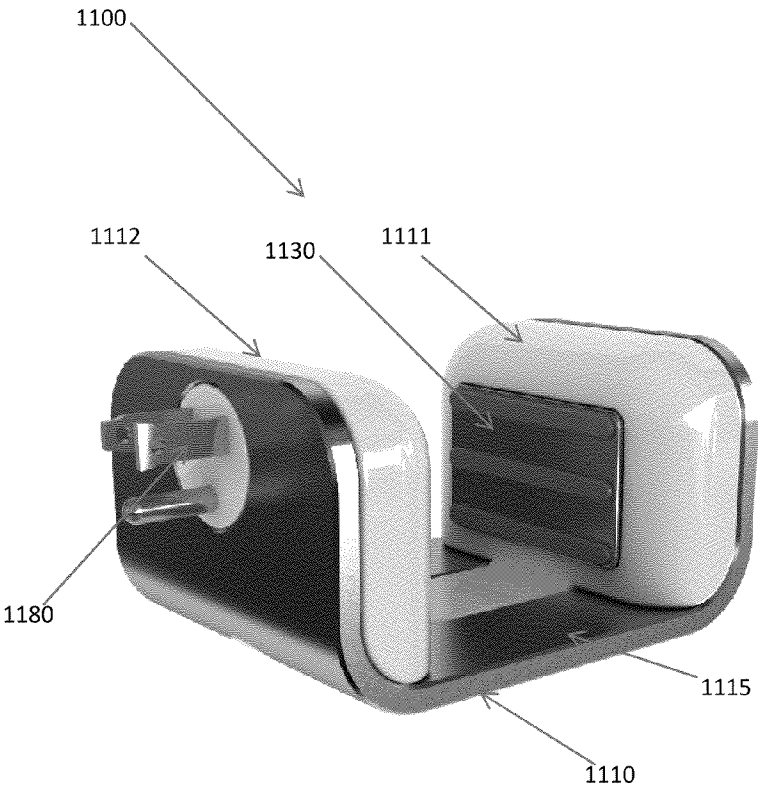
FIG. 12 is a second perspective view of the embodiment of FIG. 11 showing a male electrical connector.
Figure 11:
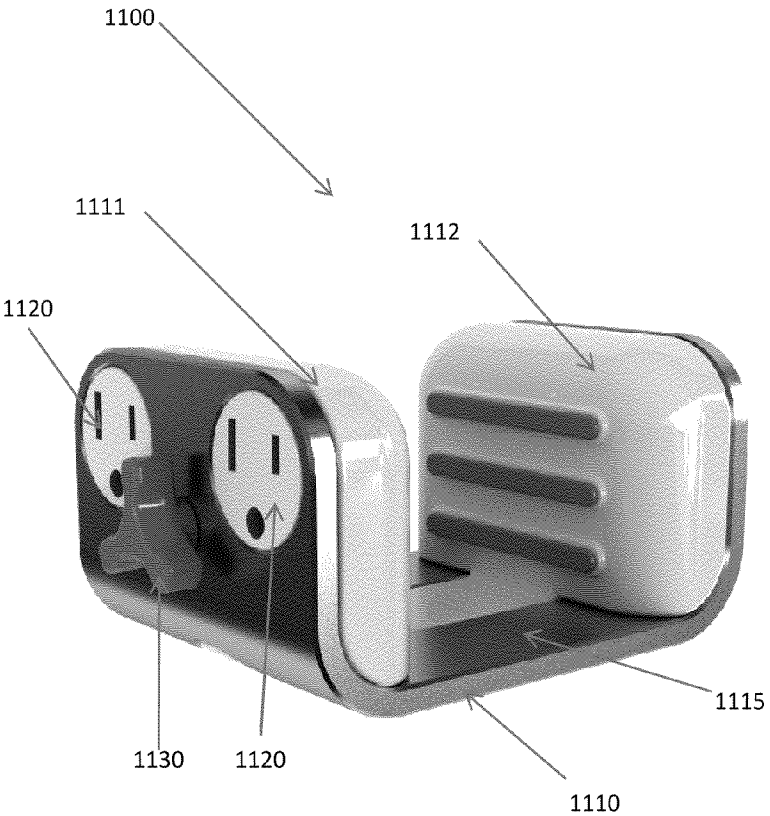
FIG. 11 is a perspective view of a further alternative embodiment of the present invention showing two female connectors positioned horizontally on one wall.

In an alternative embodiment, shown in FIG. 11, coupler 1100 has two female electrical connectors 1120. However, in this embodiment, the female electrical connectors 1120 are positioned horizontally on a side surface of first wall 1111 of body 1110. As seen in FIG. 12, a male electrical connector 1180 is positioned on a front surface of second wall 1112 of body 1110. Base plate 1115 integrally connects first wall 1111 and second wall 1112.

Figure 14:
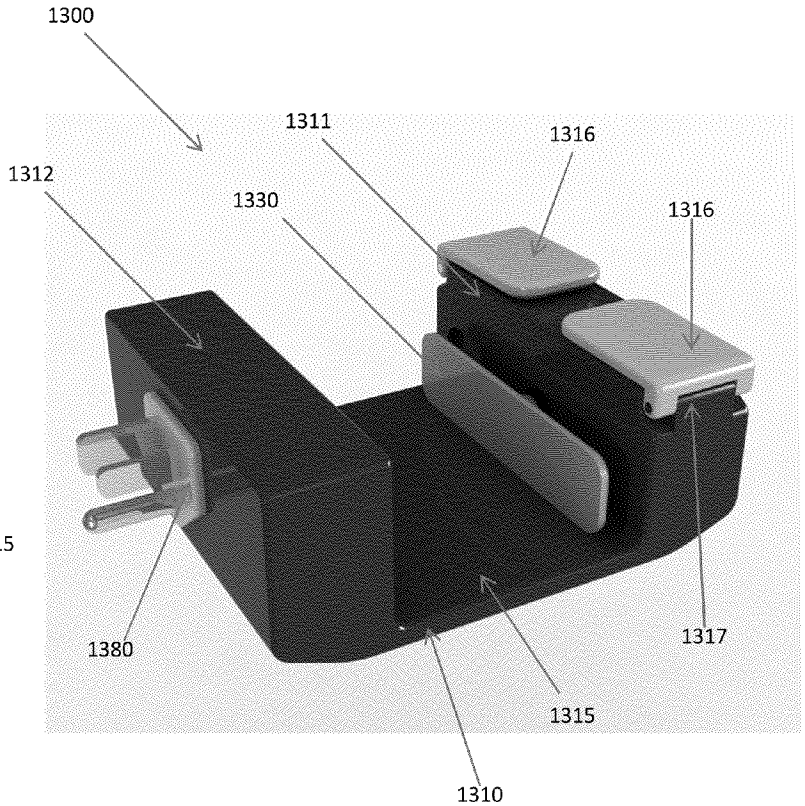
FIG. 14 is a second perspective view of the embodiment of FIG. 13 showing the protective covers in the closed position.
Figure 13:
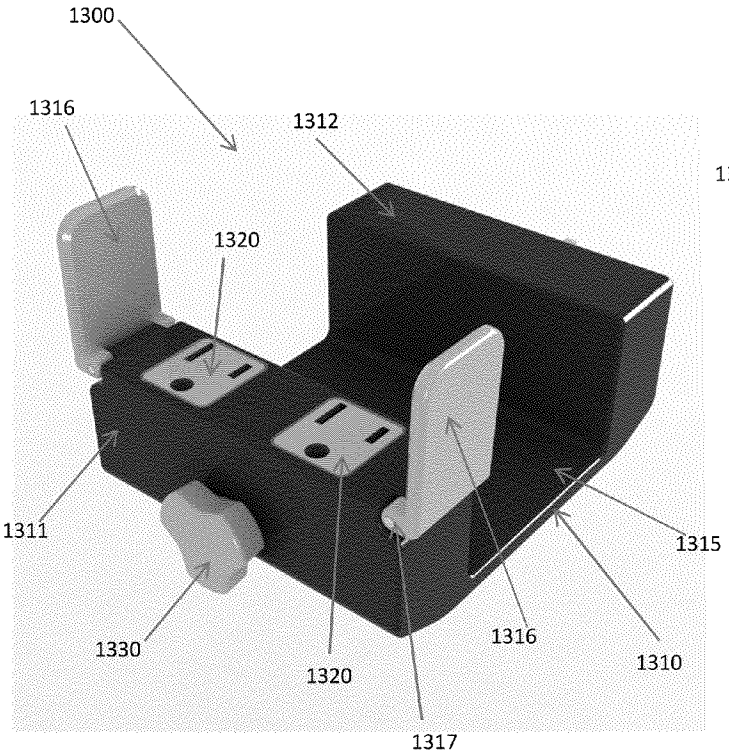
FIG. 13 is a perspective view of yet another alternative embodiment of the present invention showing two female electrical connectors positioned horizontally on a top surface of one wall and having protective covers in the open position.

In an alternative embodiment, shown in FIG. 13, coupler 1300 has two female electrical connectors 1320. However, in this embodiment, the female electrical connectors 1320 are positioned horizontally on a top surface of first wall 1311 of body 1310. As seen in FIG. 14, a male electrical connector 1380 is positioned on a front surface of second wall 1312 of body 1310. Base plate 1315 integrally connects first wall 1311 and second wall 1312. Protective covers 1316 are connected to first wall 1311 via a hinge 1317 and are positioned such that they sit atop female electrical connectors 1320.

Figure 15:
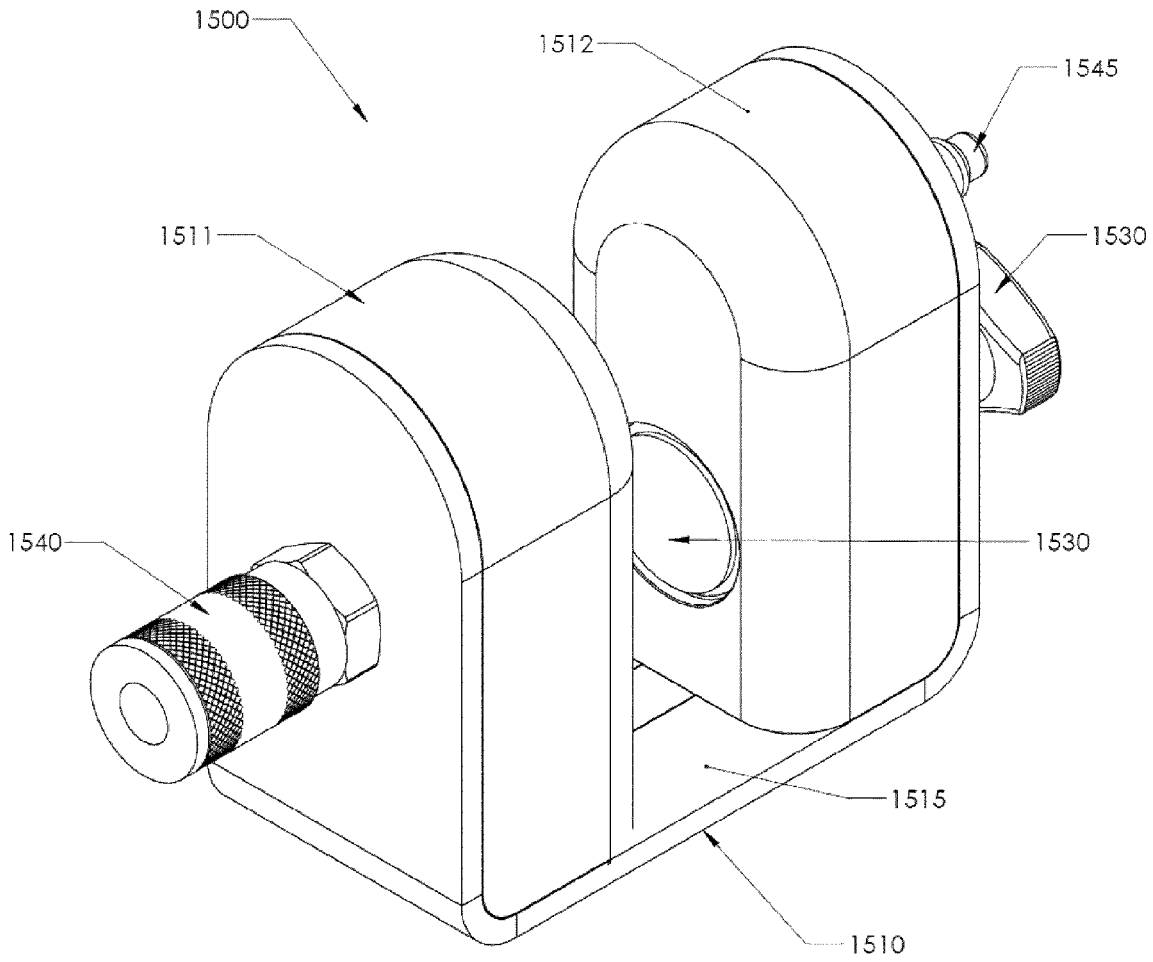
FIG. 15 is a perspective view of an alternative embodiment of the present invention showing an open pneumatic connector.

In an alternative embodiment, shown in FIG. 15, coupler 1500 has an open pneumatic fitting with an external (male) screw thread 1540 positioned on first wall 1511 of body 1510. An open pneumatic fitting with an internal (female) screw thread 1545 is positioned on second wall 1512 of body 1510. A tension screw with an adjustment knob 1530 is positioned below internal (female) screw thread 1545. Base plate 1515 integrally connects first wall 1511 and second wall 1512.

Figure 16:
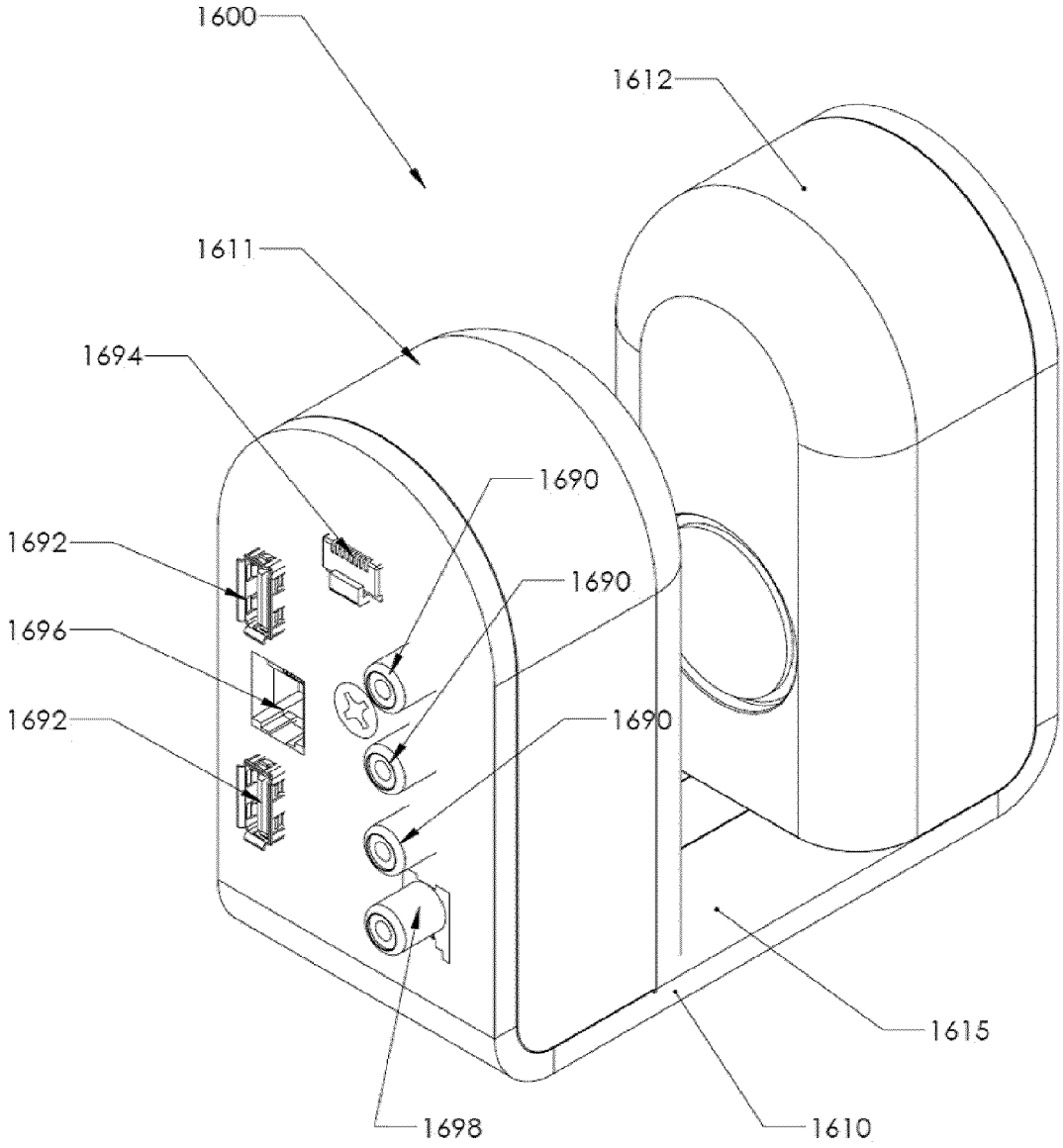
FIG. 16 is a perspective view of an alternative embodiment of the present invention showing various data connectors.

In an alternative embodiment, shown in FIG. 16, coupler 1600 has multiple data ports, including RCA ports 1690, a USB port 1692, an ethernet jack 1694, a phone jack 1696, and a coaxial connector 1698. These multiple data ports are positioned on a side surface of first wall 1611 of body 1610 and a side surface of second wall 1612 of body 1610. Base plate 1615 integrally connects first wall 1611 and second wall 1612. In other embodiments, the data ports may include connectors and/or jacks for IEEE 1394 interfaces, fiber optics, and/or multi-pin cables.

Figure 17:
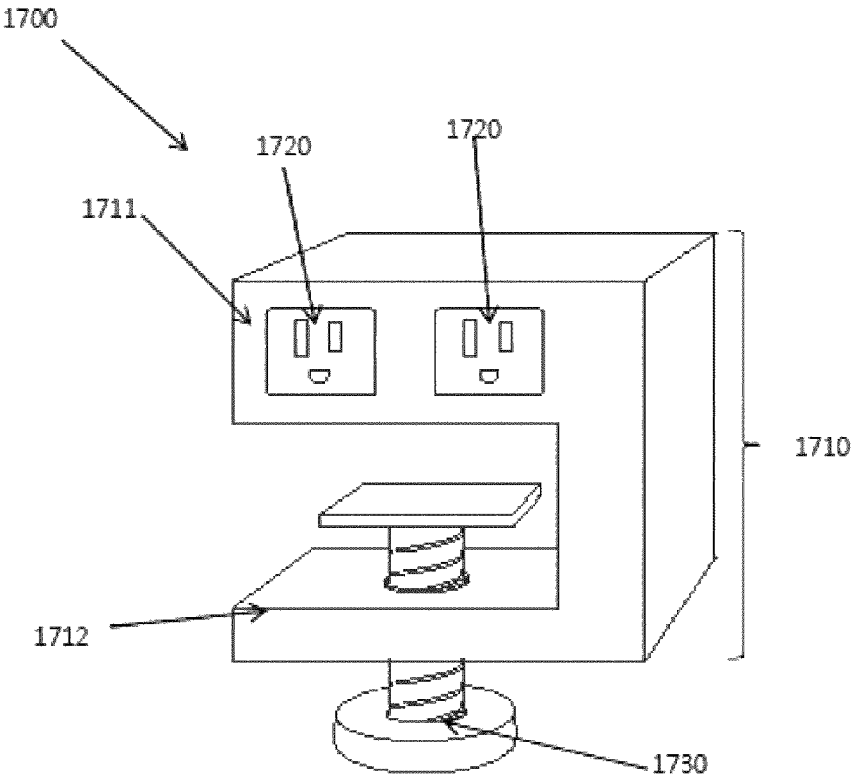
FIG. 17 is a perspective view of an alternative embodiment of the present invention showing the body as a C shaped clamp.

In an alternative embodiment, shown in FIG. 17, body 1710 of coupler 1700 is a C shaped clamp. At least two female electrical connectors 1720 are positioned on a front surface of a first wall 1711 of body 1710. In one embodiment, a tension screw with an adjustment knob 1730 is positioned on second wall 1712 of body 1710. In other embodiments, a spring loaded clip, a thumb screw, and/or a cam locking device is positioned on second wall 1712 to hold coupler 1700 in place on a piece of wood, tool bench, and/or ladder for remote power access. Using this embodiment on a ladder or tool bench allows the cumbersome weight and management of the power source extension cord to be attached to one side of the tool, with the shorter, lighter tool and power cord attached to the other side of the tool making a safer, more manageable access to power, at the task site.

Figure 18:
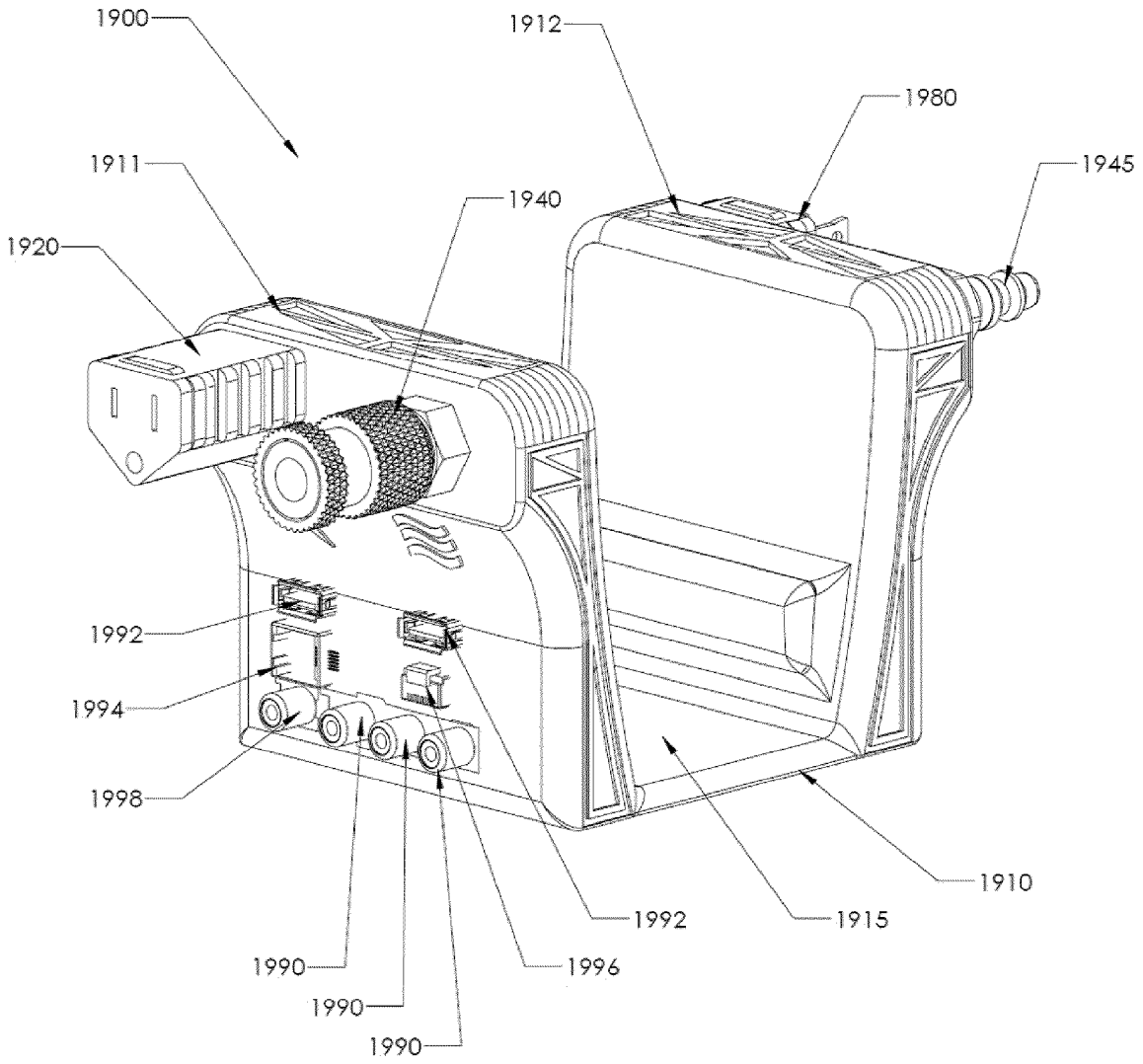
FIG. 18 is a perspective view of an embodiment of the present invention showing a female electrical connector, an open pneumatic fitting, and various data connectors.

In an alternative embodiment, shown in FIG. 18, coupler 1900 has a female electrical connector 1920 positioned on a side surface of first wall 1991 of body 1910. First wall 1911 of body 1910 also has an open pneumatic fitting with an internal (female) screw thread 1940 positioned next to the female electrical connector 1920. A male electrical connector 1980 is positioned on a side surface of second wall 1912 of body 1910. An open pneumatic fitting with an external (male) screw thread 1945 is positioned next to male electrical connector 1980. Additionally, coupler 1900 has multiple data ports, including RCA ports 1990, a USB port 1992, an ethernet jack 1994, a phone jack 1996, and a coaxial connector 1998. These multiple data ports are positioned on a side surface of first wall 1911 of body 1910 and a side surface of second wall 1912 of body 1910. The multiple data ports are positioned below the female 1920 and male 1980 electrical connectors and the female 1940 and male 1945 open pneumatic fittings. Base plate 1915 integrally connects first wall 1911 and second wall 1912. This embodiment may used in a medical setting for the transfer of gases, such as oxygen or anesthesia, as well as the transmission of data from monitors and other instrumentation.

In all embodiments, channels that allow passage of electricity, air, gas, fluid, and/or data are embedded within the body.

The foregoing has been a detailed description of illustrative embodiments of the invention. Various modifications and additions can be made without departing from the spirit and scope if this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Accordingly, this description is meant to be taken only by way of example, and not to otherwise limit the scope of this invention.

What is claimed is:

1. A coupler comprising:

a body, the body further comprising a first wall, a second wall, and a base plate, wherein the first wall of the body is connected to the second wall of the body by the base plate;

a plurality of adapters, the adapters being configured to transmit an energy source, wherein at least one adapter is a female adapter and one adapter is a male adapter, the adapters being positioned on either the first wall of the body or the second wall of the body;

a plurality of channels within the body, wherein the channels transmit the energy source between the female adapter and the male adapter; and an adjustment means for securing the first wall of body and the second wall of the body around a moveable object, wherein a bottom surface of the moveable object is disposed upon the base plate of the body.

2. The coupler of claim 1 wherein the first wall of the body, the second wall of the body and the base plate are integrally formed.

3. The coupler of claim 1 wherein the energy source is selected from the group consisting of: electricity, air, fluid, and a combination thereof.

4. The coupler of claim 1 wherein the female adapter is selected from the group consisting of an outlet, an open pneumatic fitting with an internal screw thread, and a combination thereof.

5. The coupler of claim 1, wherein the male adapter is selected from the group consisting of a plug, an open pneumatic fitting with an external screw thread, and a combination thereof.

6. The coupler of claim 1 wherein the at least one female adapter is positioned on a side surface, a front surface, or a top surface of either the first wall of the body or the second wall of the body.

7. The coupler of claim 1 further comprising a plurality of indicator lights, the indicator lights being positioned around the at least one female adapter.

8. The coupler of claim 1 wherein the adjustment means is positioned on either the first wall of the body or the second wall of the body.

9. The coupler of claim 1 wherein the adjustment means is a tension screw.

10. The coupler of claim 1 wherein the female adapter and the male adapter are completely separated from each other by the base plate.

11. The coupler of claim 1 wherein the channels within the body are lined with a plurality of electrical conduit strips.

12. The coupler of claim 11 wherein the plurality of electrical conduit strips are made of copper.

13. A coupler comprising:

a body, the body further comprising a first wall, a second wall, and a base plate, wherein the first wall of the body is connected to the second wall of the body by the base plate;

a plurality of adapters, the adapters being configured to transmit data, the adapters being opposingly positioned on either the first wall of the body or the second wall of the body;

a plurality of channels within the body, wherein the channels transmit the data between the plurality of adapters; and an adjustment means for securing the first wall of body and the second wall of the body around a moveable object, wherein a bottom surface of the moveable object is disposed upon the base plate of the body.

14. The coupler of claim 13 wherein the plurality of adapters is selected from the group consisting of: RCA ports, coaxial connectors, ethernet jacks, phone jacks, USB ports, and a combination thereof.

15. The coupler of claim 13 wherein the first wall of the body, the second wall of the body and the base plate are integrally formed.

16. The coupler of claim 13 wherein the adjustment means is positioned on either the first wall of the body or the second wall of the body.

17. The coupler of claim 13 wherein the adjustment means is a tension screw.

18. The coupler of claim 13 wherein the adapters positioned on the first wall of the body are completely separated from the adapters positioned on the second wall of the body by the base plate.

19. A coupler comprising:

a body, the body further comprising a first wall, a second wall, and a base plate, wherein the first wall of the body is connected to the second wall of the body by the base plate;

a first plurality of adapters, the adapters being configured to transmit an energy source, wherein at least one adapter is a female adapter and one adapter is a male adapter, the first plurality of adapters being positioned on either the first wall of the body or the second wall of the body;

a second plurality of adapters, the adapters being configured to transmit data, the second plurality of adapters being positioned on either the first wall of the body or the second wall of the body;

a first plurality of channels within the body, wherein the first plurality of channels transmit the energy source between the female adapter and the male adapter;

a second plurality of channels within the body, wherein the second plurality of channels transmit the data between the second plurality of adapters; and an adjustment means for securing the first wall of body and the second wall of the body around a moveable object, wherein a bottom surface of the moveable object is disposed upon the base plate of the body.

20. The coupler of claim 19 wherein the female adapter and the male adapter are completely separated from each other by the base plate.

21. A coupler comprising:

a body, the body further comprising a first wall, a second wall, and a base plate, wherein the first wall of the body is connected to the second wall of the body by the base plate;

a plurality of adapters, the adapters being configured to transmit an energy source, wherein at least one adapter is a female adapter and one adapter is a male adapter, the adapters being positioned on either the first wall of the body or the second wall of the body;

a plurality of channels within the body, wherein the channels transmit the energy source between the female adapter and the male adapter;

at least one cover, the cover being attached to either the first wall of the body or the second wall of the body by a hinge, the cover being positioned to sit upon the at least one female adapter; and an adjustment means for securing the first wall of body and the second wall of the body around a moveable object, wherein a bottom surface of the moveable object is disposed upon the base plate of the body.

* * * * *